United States Patent [19]

Joe et al.

[11] 4,168,042

[45] Sep. 18, 1979

[54] KITE STRING REEL STRUCTURE

[76] Inventors: Randal W. Joe, 1891 Caspian Ave., Long Beach, Calif. 90810; Richard A. Royall, 571 W. Covina Blvd., San Dimas, Calif. 91773

[21] Appl. No.: 925,222

[22] Filed: Jul. 17, 1978

[51] Int. Cl.[2] ..... B65H 75/40

[52] U.S. Cl. ..... 242/96; 244/155 A

[58] Field of Search ..... 242/96, 128, 99, 129, 242/84.1, 84.8; 244/155 A

[56] References Cited

U.S. PATENT DOCUMENTS

| | | | |
|---|---|---|---|
| 1,543,489 | 6/1925 | Wilson | 242/96 |
| 3,174,703 | 3/1965 | Falkum | 242/96 |
| 3,289,968 | 12/1966 | Wilson | 242/96 |

*Primary Examiner*—Edward J. McCarthy

*Attorney, Agent, or Firm*—William C. Babcock

[57] ABSTRACT

A kite string reel structure of such hollow internal configuration that a hand of a user may be removably disposed therein, and the hand when clenched grasping a transverse handle within the reel structure to support the latter in a desired position where the other hand of the user may be employed to wrap kite string on the reel or pay out kite string therefrom. When the reel structure is disposed in a substantially parallel direction to the kite string when a kite is being flown, the pull on the kite string will automatically cause a rapid pay out of kite string from the reel.

4 Claims, 6 Drawing Figures

FIG. 1
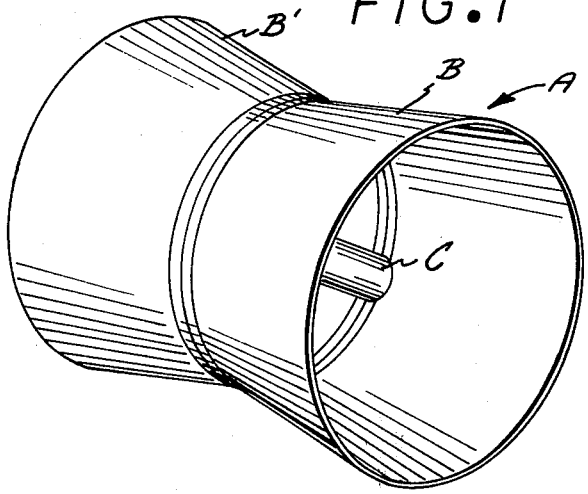
FIG. 2
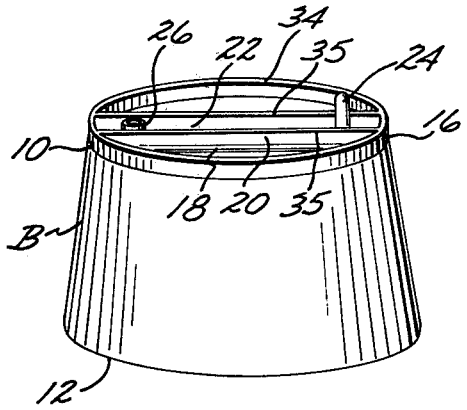
FIG. 6
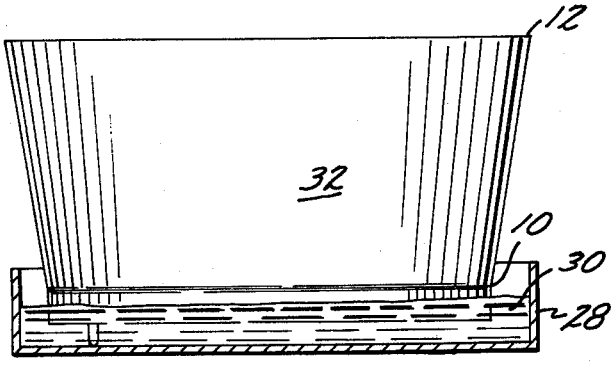
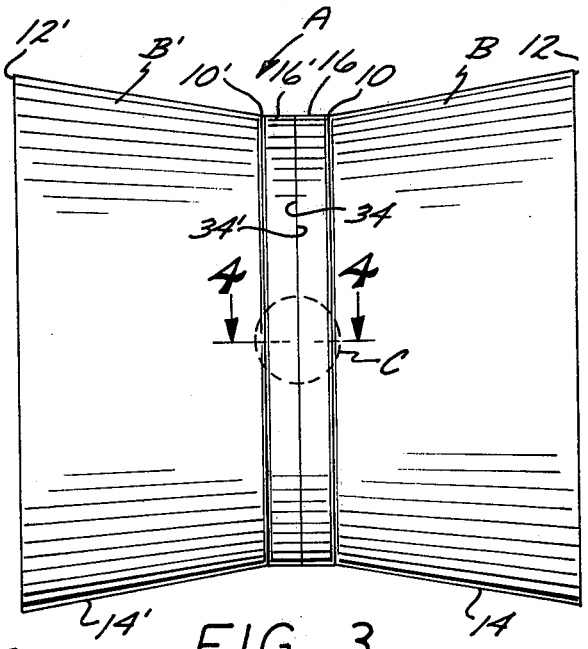
FIG. 3
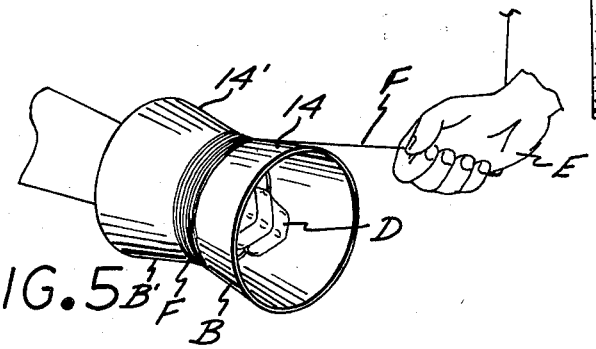
FIG. 5
FIG. 4
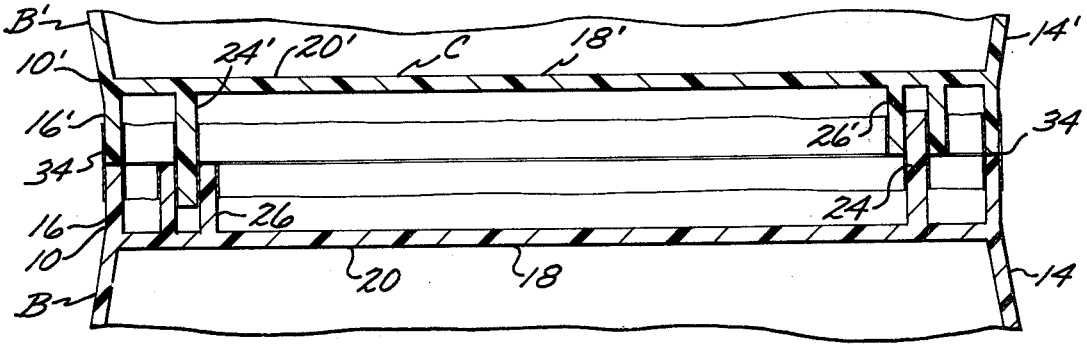

KITE STRING REEL STRUCTURE

BACKGROUND OF THE INVENTION

1. Field of the Invention

Kite string reel structure.

2. Background of the Invention

In the past various forms and designs of reels have been developed and used for retracting and paying skilled in this art, and compete competitively with one another in manipulating fighting kites. In manipulating fighting kites one competitor endeavors to so manipulate his kite as to destroy or so disable the competitor's kite that the latter will not continue to fly.

SUMMARY OF THE INVENTION

Each of the kite string reel structures includes first and second hollow members that are preferably formed from a commercially available polymerized resin and externally define a surface of revolution with each member axially being of trapezoidal shape, and each member on the end thereof of smallest transverse cross section developing into a cylindrical shell of relatively narrow width. Each cylindrical shell has a handle portion extending diametrically with the confines thereof.

Each of the handle portions is of semi-circular transverse cross section. Each handle portion within the confines thereof includes out kite string. However, such reels have been operatively unsatisfactory in that they were of an unduly complicated structure, had moving parts, were unduly expensive, and would not allow for the rapid retraction and pay out of kite string when it was desired to effect a rapid manipulation of a kite, such as occurs in the fighting of kites.

A primary object of the present invention is to provide a kite string reel structure that has an extremely simple mechanical structure, is simple and easy to use, has no moving parts, and can be fabricated at a sufficiently low price as to encourage the widespread use thereof in the flying of kites.

Another object of the invention is to furnish a kite string reel structure that is equally adapted to use by a beginner in the flying of kites as well as those that are highly on a first side thereof a prong of greater length than the depth of the handle portion and on the opposite side a tubular boss of a length not greater than the depth of the handle portion.

The kite string reel structure is formed by momentarily dipping the small end portions of the first and second hollow members in a solvent for the polymerized resin of which the members are formed, and then pressing the prongs on the members into the tubular bosses previously described until the free circumferential edges of the cylindrical edges of the cylindrical shells are in abutting contact. As the solvent evaporates the prongs and tubular bosses bond to one another, and the first and second hollow members cooperating to define a unitary kite string reel structure that may be used as previously described.

BRIEF DESCRIPTION OF THE DRAWING

FIG. 1 is a perspective view of the kite string reel structure;

FIG. 2 is a perspective view of a first half portion of the reel structure that may be combined with an identical second half portion to provide the reel structure shown in FIG. 1;

FIG. 3 is a side elevational view of the kite string reel structure;

FIG. 4 is an enlarged fragmentary longitudinal cross-sectional view of the kite string reel structure shown in FIG. 3 taken on the line 4—4 thereof;

FIG. 5 is a perspective view of the kite string reel structure being grasped by one hand of a user, with the other hand of the user controlling the paying out or winding of the kite string on the reel structure; and FIG. 6 is a side elevational view of a first half portion of the reel structure being momentarily having the smaller end portion thereof dipped into a solvent for the polymerized resin defining this half portion and prior to the two half portions being bonded together in interlocking relationship to provide the kite reel structure shown in FIG. 1.

DESCRIPTION OF THE PREFERRED EMBODIMENT

The kite string reel structure A which is the subject of the present invention is illustrated in perspective in FIG. 1, and in FIG. 5 the invention is illustrated as being grasped by one hand D of a user, with the other hand E of the user guiding a kite string F as the latter is either wound on or payed out from the kite string reel structure A. The kite string reel structure A is formed from first and second hollow members B and B' that are of identical structure and each is of circular transverse cross-section. Inasmuch as the first hollow member B is identical in structure to the second hollow member B', only the first hollow member B will be described in detail.

The first hollow member B has a first end 10 and second end 12, with the second end 12 being of substantially larger diameter than the first end 10, and the second end of sufficient transverse cross section as to permit a hand D of a user (not shown) to be inserted therein, and after such insertion clenched to grasp a tubular transverse handle C.

The first hollow member B defines a continuous side wall 14 that extends between the first end 10 and second end 12 of the hollow member, with the side wall 14 in an axial direction being trapezoidal in shape. The side wall 14 on the first end 10 develops into a cylindrical shell 16.

The cylindrical shell 16 has a handle portion 18 extending diametrically within the confines thereof, with handle portion 18 being semi circular in transverse cross section and having a semi-cylindrical external surface 20 and semi-cylindrical internal surface 22.

The handle portion 18 has a prong 24 that extends outwardly from the internal surface 22 thereof, with the prong being longer than the depth of the cylindrical shell. A tubular boss 26 is spaced from the prong 24 and extends outwardly from the internal surface 22, but with the tubular boss being of no greater length than the depth of the handle portion 18.

In forming the kite string reel structure A, the handle portion 18, prong 24 and tubular boss 26 are momentarily lowered into a receptacle 28 that contains a solvent 30 for the particular polymerized resin 32 of which the hollow member B is formed. After the free edge portions 34 of the handle portion 18, the prong 24 and tubular boss 26 have been wet with the solvent 30, the prong 24 and tubular boss 26 are caused to engage the tubular boss 26' and prong 24' of the second hollow member B'. The second hollow member B' has the same elements as the first hollow member B, and these elements being identified on the drawing by the numerals and letters used in identifying the same components on the first hollow member, but with primes being added thereto. After the first hollow member B has been wet with the solvent 30, as above described, the first and second hollow members B and B' are placed in axial alignment as shown in FIGS. 1 and 3, with the free circumferential edges 34 of the shell 16 in abutting contact, as well as the free edges 35 of the semi-cylindrical handle portions 18.

The kite string reel structure A as may best be seen in FIG. 5 is of sufficient internal transverse cross-section and of sufficient longitudinal length that the hand B of a user (not shown) may be completely disposed within the confines thereof, and the hand when in the form of a fist grasping the tubular handle C, and being centrally disposed relative to the kite string reel structure A. The kite string reel structure A when so grasped by a hand D of a user, may have kite string F wound on or payed out from the reel structure by use of the second hand E of the user as illustrated in FIG. 5. When it is desired to dispense the kite string F rapidly from the kite string reel structure A, the latter is disposed substantially parallel to the kite string and the kite string F will automatically be dispensed therefrom, which is particularly desirable when it is desired to rapidly maneuver a kite to allow the latter to rise rapidly.

In FIG. 6 it will be seen that the first hollow member B is being momentarily dipped into the solvent 30 prior to assembly with the second hollow member B', but if desired, both the first and second hollow members B and B' may be so dipped prior to being pressed together to form a kite string reel structure A of unitary construction. Due to the central positioning of the tubular handle C and the longitudinal length and transverse cross section of the reel structure A, the pull of the string F is centered relative to the clenched fist of the hand D in engagement with the handle C, and the forearm of the user is able to withstand any sudden stresses imposed by the string F on the reel structure A. In other words, there is no tendency for the kite string reel structure A to pivot relative to the hand D of the user that is in engagement with the reel structure when a sudden force is exerted on the reel structure by the string F. Also, due to the construction above and described, the internal surfaces of the hollow members B and B' are smooth, and this also applies to the tubular handle C, so that there are no sharp edges that will cut or abraid the hand D of a user when the hand is in grasping engagement with the handle C.

The use and operation of the invention has been explained previously in detail, as well as the mode of manufacturing the same, and the description thereof is not deemed required.

What is claimed is:

1. A kite string reel that envelops a supporting hand of a user when the latter is in a clenched position, said kite string reel including:

a. a pair of axially aligned hollow members that include a pair of cylindrical shells that have first circumferential edges that are in abutting contact, and said pair of hollow members including hollow portions that extend outwardly from said cylindrical shells in opposite directions, said hollow portions being of trapezoidal shape in a longitudinal direction, and said hollow portions being of sufficient length and having outwardly disposed open ends of sufficient transverse cross-section that a hand of a user may be disposed in and enveloped by said pair of hollow members;

b. a pair of handle elements that extend diametrically within said cylindrical shells, each of said handle elements of generally semi-circular transverse cross-section, and said handle elements each defining a pair of longitudinal free edges, said longitudinal free edges being in abutting contact, and said handle elements cooperating when said free edges thereof are in said abutting contact a handle of generally circular transverse cross-section that may be grasped by a hand of a user when the latter is within said kite string reel and the hand is in a clenched position; and c. engageable and engaging means supported from said handle elements which when in engagement holding said cylindrical shells, hollow portions, and said handle elements together as an integral assembly to define said kite string reel.

2. A kite string reel as defined in claim 1 in which said engageable and engaging means are tubular bosses and prongs that extend from the interior surfaces of said handle elements and permanently interlock when said free edges of said handle elements are in abutting contact.

3. A kite string reel as defined in claim 2 in which said cylindrical shells, outer portions, handle elements, said tubular bosses and said prongs are formed from a polymerized resin.

4. A kite string reel as defined in claim 3 in which said prongs extend into said tubular bosses and are permanently held therein by a film of said resin that is an integral part of both said prongs and said tubular bosses, with said prongs and tubular bosses in addition to securing said cylindrical shells and outer portions to one another also serving to prevent relative rotation of said cylindrical shells, outer portions and said handle elements to one another.

* * * * *